US006386390B1

(12) United States Patent
Tinker

(10) Patent No.: US 6,386,390 B1
(45) Date of Patent: May 14, 2002

(54) AUTOMATIC SOAP DISPENSER

(76) Inventor: Frank A. Tinker, P.O. Box 36683, Tucson, AZ (US) 85740

( * ) Notice: Subject to any disclaimer, the term of this patent is extended or adjusted under 35 U.S.C. 154(b) by 0 days.

(21) Appl. No.: 09/452,592

(22) Filed: Dec. 1, 1999

(51) Int. Cl.[7] ..... B67D 5/08
(52) U.S. Cl. ..... 222/52; 222/571; 250/221
(58) Field of Search ..... 222/52, 481.5, 222/181.3, 571; 250/221

(56) References Cited

U.S. PATENT DOCUMENTS 5,405,058 A * 4/1995 Kalis et al. ..... 222/185
5,505,340 A * 4/1996 McBride, Jr. ..... 222/135

* cited by examiner

*Primary Examiner*—Kevin Shaver
*Assistant Examiner*—Patrick Buechner
(74) *Attorney, Agent, or Firm*—Antonio R. Durando; Durando Birdwell & Janke, P.L.C.

(57) ABSTRACT

A dispenser has a container for a liquid, a vent opening to allow air into the container, a valve to control the admission of air into the container, and a dispensing opening for the liquid to be dispensed therefrom. The dispenser is mounted with the dispensing opening at the bottom. When the valve is closed, a pressure differential is created that prevents the liquid in the container from flowing out. Upon opening of the vent valve, the pressure differential is reduced and dispensing can continue. Such a dispenser can be used to dispense fluids of varying viscosities and even nonporous solids. In one embodiment of the invention, an infrared radiation emitter and an infrared radiation detector are arranged in such a manner that, when a hand is placed below the dispenser, radiation from the emitter impinges on the hand and is reflected to the detector. Upon sensing the reflected radiation, the detector causes the valve for the vent tube to open so that the pressure differential in the container is eliminated and the liquid can be dispensed. When the hand is withdrawn, the detector no longer senses radiation from the emitter and causes the valve for the vent tube to close reestablishing the pressure differential that stops the outflow of liquid. The dispensing opening is preferably in the form of an S-shaped tube to prevent dripping of the liquid, such as soap, when the valve is closed.

6 Claims, 5 Drawing Sheets

AUTOMATIC SOAP DISPENSER

BACKGROUND OF THE INVENTION

1. Field of the Invention

The invention relates to a dispenser for flowable soap.

2. Description of the Prior Art

Most dispensers for flowable soap are currently manually operated, which means that the dispenser must be touched when soap is to be dispensed. Since it is unsanitary to touch the dispenser, it would be desirable to be able to obtain soap without touching the dispenser.

Accordingly, several automatic dispensers have been developed employing two distinct principles for delivering fluid from a reservoir. The first technique makes use of a pump, which can be solenoid operated, rotating-cam operated, or actuated by deformation of a flexible reservoir. Pumps are inefficient in this type of application because any change in the kinetic or potential energy of the fluid must be provided by the electrical source energizing the pump.

More efficient devices use gravity to provide the force necessary to move the liquid. Accordingly, another technique is to position an electrically actuated valve below the fluid reservoir. When the valve is opened, the fluid is forced through it by gravity. This design is necessarily inefficient because the aperture size of the valve must be adapted as a function of the viscosity of the fluid that must flow through it. Thus, larger apertures require more energy to open them. Therefore, a more efficient automatic-dispenser design would be desirable for reasons of economics and energy conservation.

SUMMARY OF THE INVENTION

It is an object of the invention to eliminate the need for touching a dispenser in order to dispense a liquid such as soap therefrom.

Another objective of the invention is a design for an automatic dispenser that is suitable for liquids of various viscosities.

Another goal is a dispenser that utilizes gravity as the motive force for the liquid being dispensed.

Still another goal is a dispenser that operates with increased efficiency regardless of the viscosity of the liquid being dispensed.

Another objective is a design that can be implemented efficiently and economically.

Still another object is a dispenser that prevents dripping of the dispensed liquid between uses.

The preceding objects, as well as others which will become apparent as the description proceeds, are achieved by the invention.

One aspect of the invention resides in a dispenser for a liquid, such as liquid soap. The dispenser comprises a container for a supply of soap, and the container is provided with at least one opening for discharging soap therefrom. The dispenser further comprises means for detecting objects at a spacing from the container, and means for controlling the passage of soap through the discharging opening. The controlling means has a first condition in which soap is free to pass through the discharging opening and a second condition in which the passage of soap through the opening is inhibited. The controlling means is designed to assume the first condition in response to the detection of an object by the detecting means and to revert to the second condition in response to discontinued detection of the object. The detecting means can detect a hand which is spaced from the dispenser and is designed so that soap is dispensed when a hand is detected. Hence, the dispenser in accordance with the invention makes it unnecessary to touch the dispenser in order to obtain soap therefrom.

According to another aspect of the invention, the dispenser consists of a closed reservoir having a dispensing opening at its lower extremity through which the liquid can flow. As the fluid flows out of the reservoir through the opening, the pressure at the top in the reservoir is gradually reduced until the pressure differential between the inner top portion of the reservoir and the ambient, external atmospheric pressure is sufficient to stop the flow of fluid. An electrically actuated valve is positioned to admit air from outside the reservoir into the upper, low pressure, area of the reservoir to allow the fluid to flow from the reservoir through the lower opening.

Another aspect of the invention resides in a method of operating a soap dispenser. The method comprises the steps of placing an object at a predetermined location spaced from the dispenser, sensing the object while the object is at such location, and dispensing soap from the dispenser in response to the sensing step. The sensing step may include detecting energy reflected from the object, and the energy can comprise infrared radiation. The method can further comprise the steps of removing the object from the predetermined location, discontinuing the sensing step upon removal of the object from this location, and terminating the dispensing step in response to discontinuation of the sensing step.

The method may also comprise the step of inhibiting the dripping of soap from the dispenser subsequent to the terminating step. The dispenser can include a soap container and a supply of soap in the container, and the dispensing step may involve establishing communication between the soap supply and the atmosphere.

Additional features and advantages of the invention will be forthcoming from the following detailed description of preferred embodiments when read in conjunction with the accompanying drawings.

DESCRIPTION OF THE PREFERRED EMBODIMENTS

Figure 1:
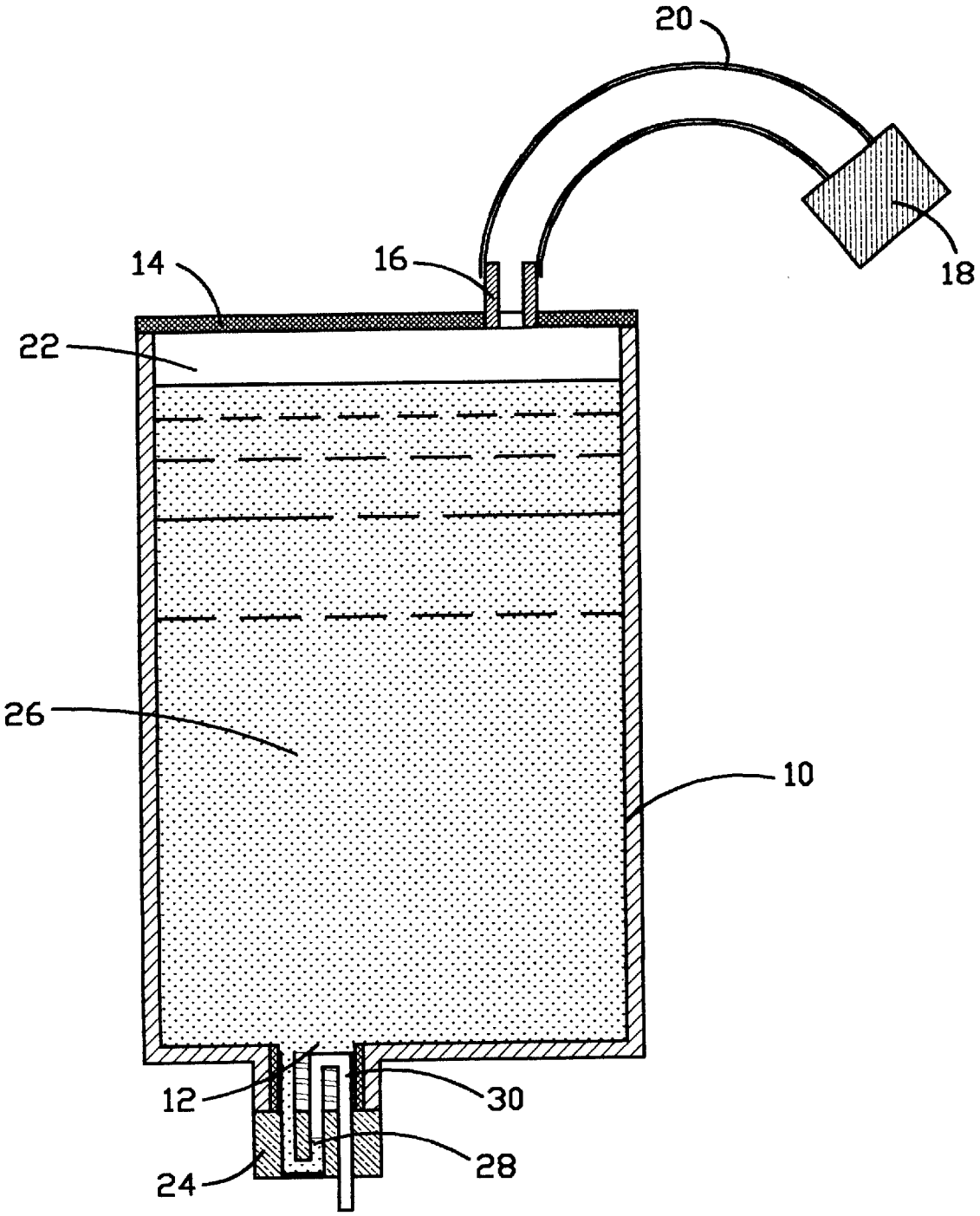
FIG. 1 is a schematic view of a dispenser according to the preferred embodiment of the invention.

Referring to the drawings, wherein like parts are designated throughout with like numerals and symbols, FIG. 1 illustrates schematically a rigid reservoir 10 constructed with an opening 12 at the bottom and a sealed removable top 14. The top is fitted with a small hose barb 16 that is connected to a valve 18 by a small tube 20 to admit air into the upper portion 22 of the reservoir. The opening 12 in the bottom of the reservoir 10 is preferably threaded to allow various dispensing nozzles, such as the S-shaped nozzle 24, to be removably attached. The shape of the nozzle 24 is provided to inhibit post-dispense dripping as well as dripping due to atmospheric pressure variations.

The valve 18 is preferably a normally-closed miniature valve, such as the Clippard EE3-TL-12 Double E-3 Subminiature Electronic Valve made by Clippard Instrument Laboratory, Inc., of Cincinnati, Ohio. When open, the valve 18 admits air into the upper portion 22 of the reservoir, thereby allowing fluid in the reservoir to flow through the opening 12 and the nozzle 24. As well understood in the art, the dispensing nozzle 24 can be constructed in a variety of internal diameters to achieve equal dispensing volumes for liquids with different viscosities. For a target dispensing time period and a given liquid volume in the reservoir, a variation in the kinematic viscosity of the liquid can be accounted for by the known relationship $D_1/D_2=[v_1/v_2]^{1/4}$, where $v_1$ and $v_2$ are the kinematic viscosities of two alternative liquids and $D_1$ and $D_2$ are corresponding internal diameters for the dispensing nozzle. See Fox et al., *Introduction to Fluid Mechanics*, Wiley & Sons (1985).

Upon receiving a dispense signal, the valve 18 is opened to admit air into the upper reservoir cavity 22. In response, the liquid 26 contained in it begins to flow through the opening 12 and the dispensing nozzle 24. The kinetic energy of the flowing liquid causes the upper reservoir cavity 22 to "overshoot" the equilibrium pressure differential required to just balance the liquid depth to stop the flow. Thus, the excess pressure differential causes the liquid to be "sucked back" into the reservoir such that the equilibrium position of the liquid-air interface 28 in the nozzle is drawn to the intermediate section of the S-shaped tube in the dispensing nozzle. It is understood that for the dispenser to drip, the liquid-air interface 28 would need to be in the outer section 30 of the tube in dispensing nozzle, which is no longer the case. Therefore, the combination of the nozzle design and the vacuum-controlled release of the liquid effectively prevents dripping when the valve 18 is closed. Similarly, atmospheric-pressure changes can cause the migration of the liquid-air interface 28 along the tube of the dispensing nozzle, but the dispenser can tolerate atmospheric-pressure reductions equal to the liquid head separating the current height of the interface 28 from the top of the intermediate section of the S-shaped tube in the nozzle 24, as would be clearly understood by one skilled in the art.

Figure 2:
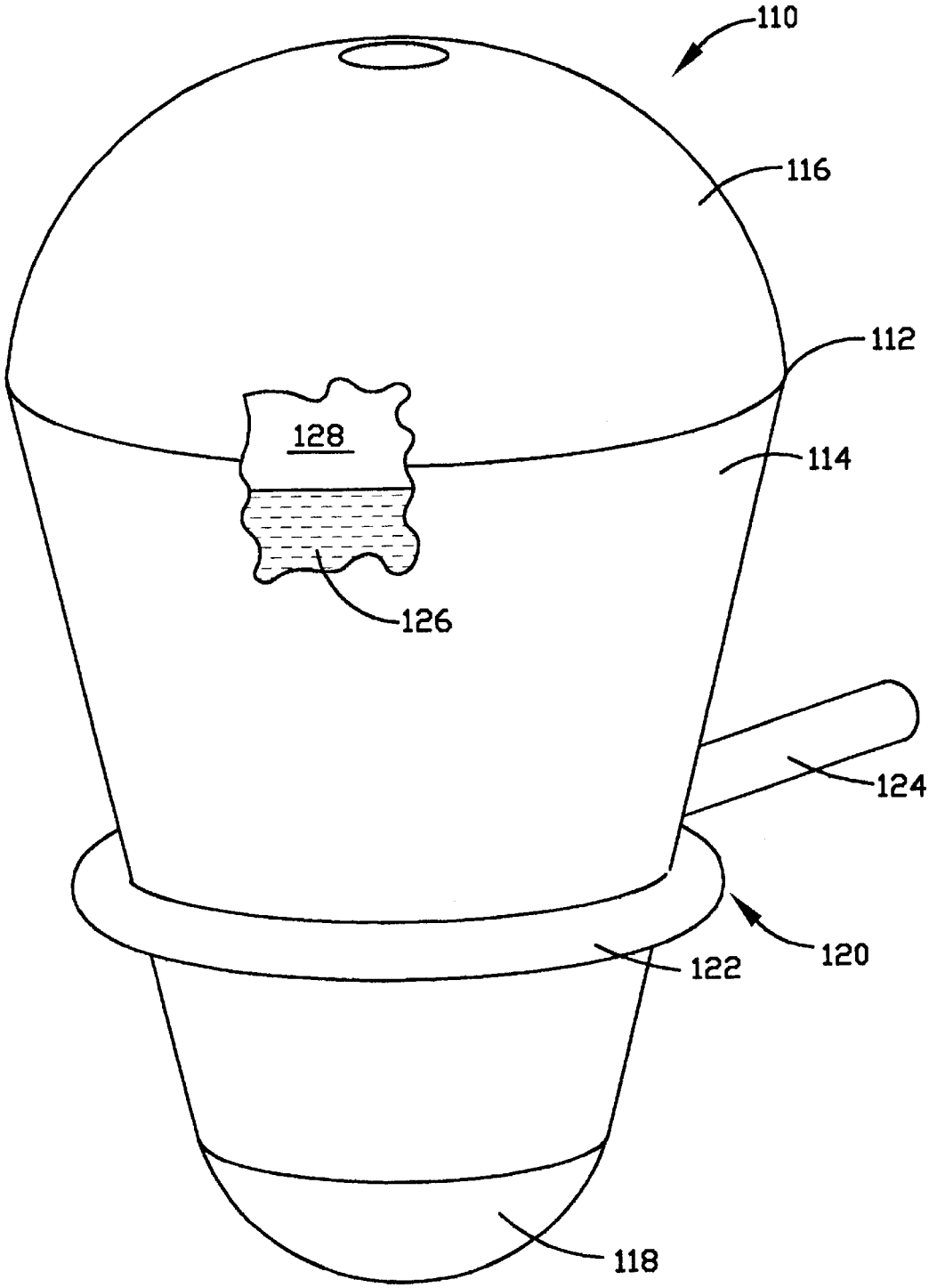
FIG. 2 is a perspective view of a soap dispenser according to the invention in a holder.

Referring to FIG. 2, the numeral 110 identifies another embodiment of an automatic dispenser in accordance with the invention. The dispenser 110 is designed to dispense liquid soap in a flowable form and is especially well-adapted for that application. The soap dispenser 110 comprises a container 112 for holding a supply of soap. The container 112 includes a generally frustoconical reservoir or body 114 and a cover 116 which is removably mounted on one axial end of the reservoir 114. The cover 116 can, for instance, be screwed onto the reservoir 114, be a press fit on the reservoir or be held on the reservoir by suitable fasteners, such as screws. The soap dispenser 110 further comprises a lower cap or housing 118 which is removably mounted on the axial end of the reservoir 114 remote from the cover 116. Similarly to the cover 116, the cap 118 can, for example, be screwed onto, press fit, or held on the reservoir 114 by suitable fasteners.

FIG. 2 shows the soap dispenser 110 being supported in a holder 120. The holder 120 includes a ring 122 having an inner diameter smaller than the maximum outer diameter of the reservoir 114 so that the reservoir can rest on the ring 122 when inserted in the latter. The holder 120 further includes a shank 124 which extends radially outward from the ring 122 and serves as a mounting element for the holder 120. Thus, the shank 124 allows the holder 120 to be affixed to a surface such as a wall surface. The reservoir 114 accommodates a supply or body of soap 126. Between the soap 126 and the cover 116 is an empty space 128 which is essentially airtight.

Figure 3:
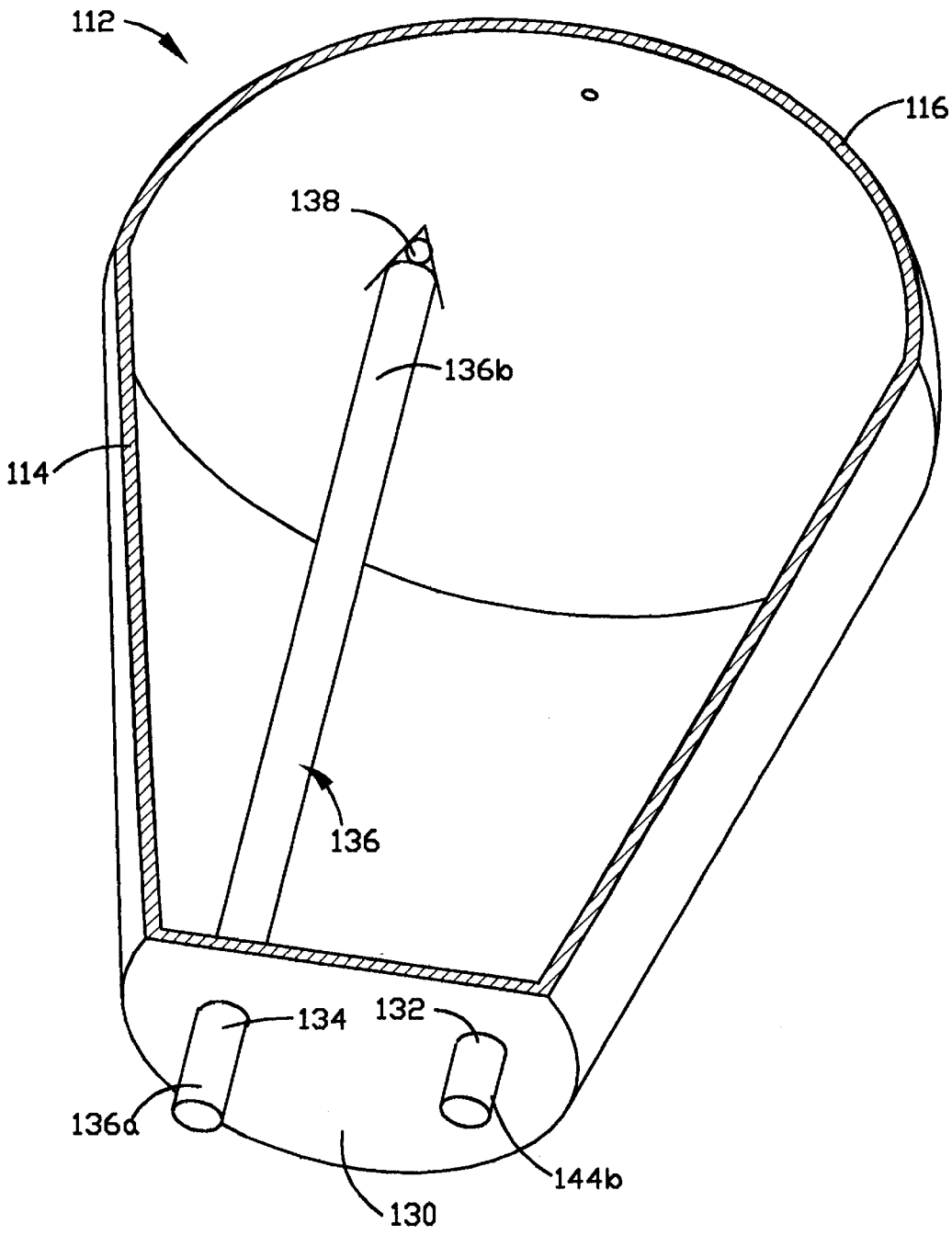
FIG. 3 is a partly sectional perspective view of a soap reservoir constituting part of the soap dispenser of FIG. 2.

Turning to FIG. 3, the end of the reservoir 114 remote from the cover 116 is closed by a wall 130 which separates the interior of the reservoir 114 from the interior of the cap 118. The wall 130 is provided with an opening 132 through which the soap 126 can be discharged from the reservoir 114. The wall 130 is provided with a second opening 134 which is spaced from the discharging opening 132. A vent tube 136 passes through the opening 134 and extends through the reservoir 114 as well as through the cap 118. The vent tube 136 has opposite longitudinal ends **136*a* and 136*b* which are provided with apertures so that the vent tube 136 is open at either longitudinal end 136*a*,136*b*. The longitudinal end 136*a* is located in the empty space 128 of the container 112, and a check valve 138 is mounted in the longitudinal end 136*a*. The check valve 138 prevents the soap 126 from flowing into the vent tube 136 if the container 112** should be tilted.

Figure 4:
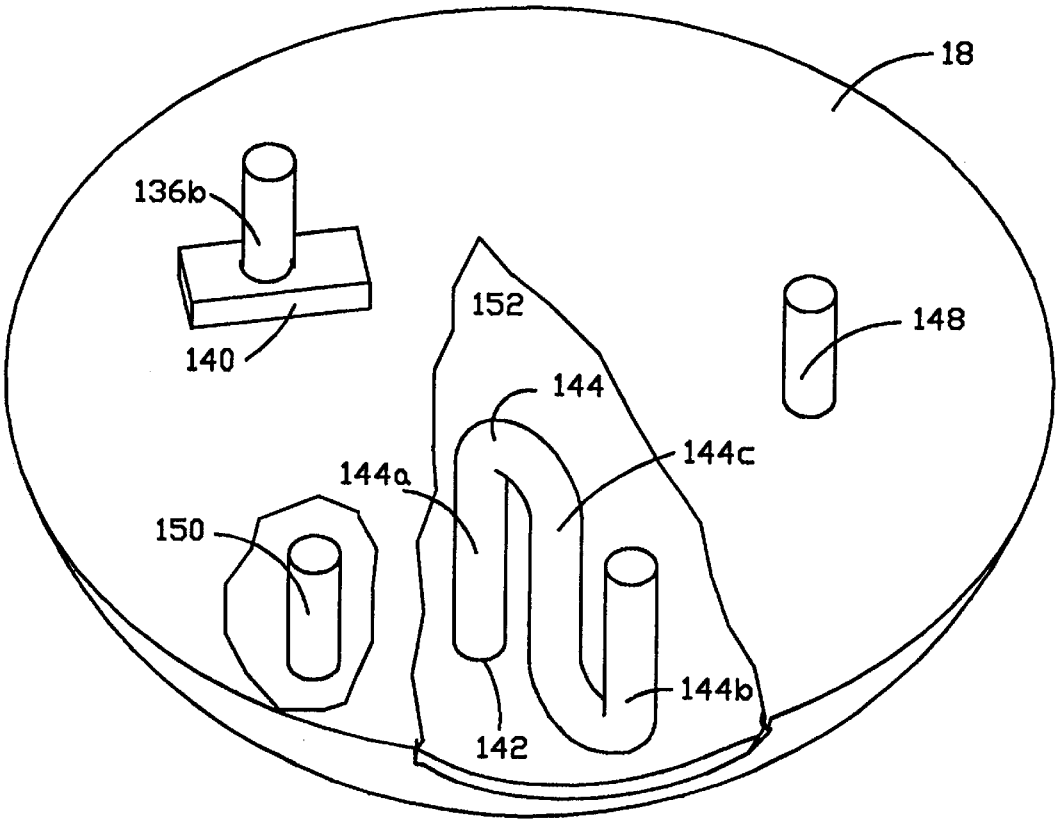
FIG. 4 is a partially cut-out, enlarged perspective view of a cap constituting part of the soap dispenser of FIG. 2.

Considering the enlarged view of FIG. 4, a valve 140 is mounted inside the cap 118 at the longitudinal end **136*b* of the vent tube 136. The valve 140 is preferably a miniature valve such as described above. The valve 140 has an open condition or open position in which the valve establishes communication between the interior of the vent tube 136 and the atmosphere. The valve 140 also has a closed condition or closed position in which the interior of the vent tube 136** is sealed from the atmosphere.

In the open condition of the valve 140, the space 128 in the container 112 communicates with the atmosphere by way of the vent tube 136 and is at atmospheric pressure. The soap 126 is then free to flow out of the container 112 via the discharging opening 132. When the valve 140 is subsequently placed in the closed condition, a vacuum is produced in the space 128 and causes the soap 126 to stop flowing out of the container 112. The vent tube 136 and valve 140 can thus be considered to constitute a means for controlling the passage of the soap 126 through the discharging opening 132.

The cap 118 is provided with a central opening 142. A tubular member 144 extends between the cap opening 142 and the discharging opening 132 of the reservoir 114. The tubular member 144 establishes a flow path for the soap 126 from the reservoir 114 to the cap opening 142. The cap opening 142 constitutes a dispensing opening through which the soap 126 is dispensed from the soap dispenser 110. As in the embodiment of FIG. 1, the tubular member 144 is designed to inhibit or prevent the dripping of soap from the dispenser 110. To this end, it is preferred for the tubular member 144 to have a generally S-shaped configuration as shown. Thus, the tubular member 144 includes a straight section **144*a* extending from the dispensing opening 142, a straight section 144*b* extending from the discharging opening 132, and a curved section 144*c* connecting the straight sections 144*a*,144*b* to one another. The curved section 144*c* defines a depression between the straight sections 144*a*, 144*b***.

Also mounted in the cap 118 are an energy emitter 148 and an energy detector 150. The energy emitter 148 is arranged to direct energy to a location which faces the dispensing opening 142 in the cap 118 and is spaced from the cap 118. On the other hand, the energy detector 150 is arranged to detect energy reflected from an object at such location. The energy detector 150 is designed to detect energy having the same frequency or frequency range as the energy emitted by the energy emitter 148.

The cap 118, or at least the portions of the cap 118 adjacent to the energy emitter 148 and the energy detector 150, are transparent to the energy emitted by the energy emitter 148. Hence, the cap 118 does not interfere with the transmission of energy emitted by the energy emitter 148. The energy emitter 148 and the energy detector 150 are preferably designed to emit and detect infrared radiation. The energy emitter 148 and the energy detector 150 are spaced from one another, and a partition or wall 152 extends across the interior of the cap 118 between the energy emitter 148 and the energy detector 150. The partition 152 separates the energy emitter 148 and the energy detector 150 from each other and is opaque to the energy emitted by the energy emitter 148. The partition 152 prevents energy generated by the energy emitter 148 from reaching the energy detector 150 unless the energy has been reflected from an object which faces the dispensing opening 142 and is spaced from the cap 118. Thus, the partition 152 prevents energy generated by the energy emitter 148 from traveling directly to the detector 150. Likewise, the partition 152 prevents energy which is generated by the energy emitter 148 and then reflected by the cap 118 from reaching the energy detector 150.

Figure 5:
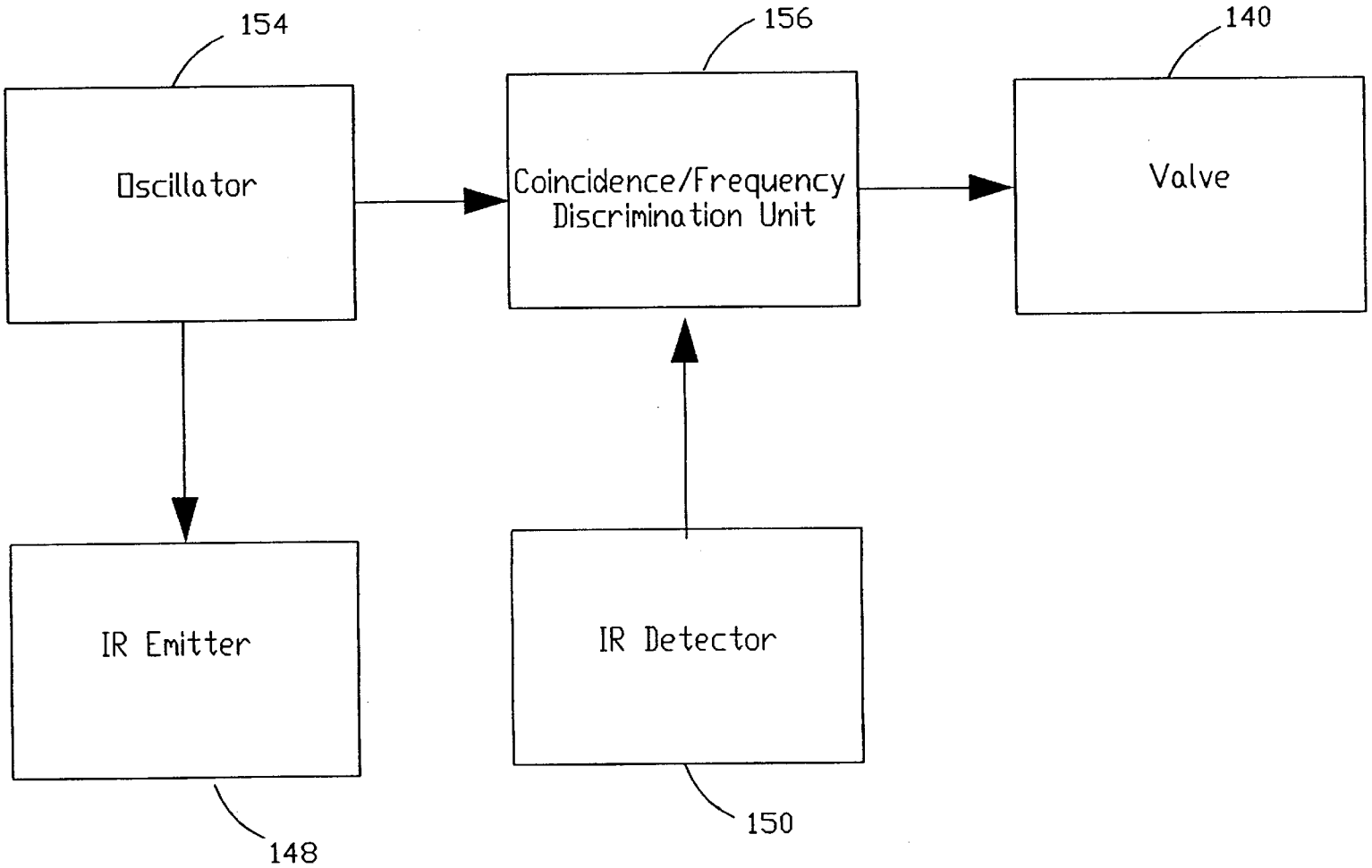
FIG. 5 is a block diagram of circuitry for operating the soap dispenser of FIG. 2.

With reference to FIG. 5, the energy emitter 148 is driven by an oscillator 154 which functions as a clock. Thus, the oscillator 154 periodically sends a signal to the energy emitter 148 which thereupon generates an energy pulse having a predetermined frequency. The signals produced by the oscillator 154 also go to a coincidence and frequency discrimination unit 156. The energy detector 150 is energized whenever the energy detector 150 senses energy having a frequency within a predetermined range. The energy detector 150 then generates output signals indicative of the frequency of the energy impinging upon the energy detector 150. The signals produced by the energy detector 150 are sent to the discrimination unit 156.

The discrimination unit 156 performs two main functions. On the one hand, the discrimination unit 156 determines whether the signals arriving from the energy detector 150 coincide with the signals arriving from the oscillator 154. On the other hand, the discrimination unit 156 determines whether the energy sensed by the energy detector 150 has the same frequency as the energy emitted by the energy emitter 148. If both conditions hold true, the discrimination unit 156 concludes that the energy detector 150 is sensing energy coming from the energy emitter 148 by reflection from an object near the dispensing opening 142. The discrimination unit 156 then causes the valve 140 to assume its open condition. When the signals from the energy detector 150 cease, no longer coincide with the signals from the oscillator 154, or no longer have the same frequency as the signals from the energy emitter 148, the discrimination unit 156 causes the valve 140 to assume its closed condition. The oscillator 154 can be keyed to the discrimination unit 156.

Referring back to FIG. 4, the valve 140, energy emitter 148, energy detector 150, oscillator 154 and discrimination unit 156 are all fixed to a circuit board 158 removably mounted inside the cap 118. The circuit board 158 runs circumferentially of the cap 118 and may be circumferentially complete. If the circuit board 158 is circumferentially complete, the circuit board 158 is provided with a central opening for the tubular member 144. The circuit board 158 can, for example, have a generally annular configuration. Power for the valve 140, energy emitter 148, energy detector 150, oscillator 154 and discrimination unit 156 is supplied by a small battery connected to the circuit board 158.

The soap dispenser 110 is of the gravity-fed type as opposed to the pump type. Thus, with the soap dispenser 110, gravity rather than a pumping action is used to discharge the soap 126 from the dispenser 110.

One manner of operation of the dispenser 110 will be described assuming that the dispenser 110 is mounted on a wall in the upright position of FIG. 2. It is further assumed that the energy emitter 148 emits infrared radiation and that the energy detector 150 is designed to sense infrared radiation. The energy emitter 148 periodically emits a pulse of infrared radiation having a predetermined frequency. The rate at which the pulses are generated is determined by the oscillator 154 which activates the energy emitter 148 at regular intervals and sends a signal to the discrimination unit 156 upon each activation. As long as no objects are placed below and in the vicinity of the dispensing opening 142, the radiation pulses are dissipated and are not detected by the energy detector 150. Consequently, the energy detector 150 sends no signals to the discrimination unit 156 which, in turn, causes the valve 140 to be in its closed condition. The space 128 above the soap 126 in the soap container 112 is cut off from the atmosphere and a vacuum exists in the space 128. The vacuum prevents the soap 126 from flowing out of the reservoir 114.

When a hand is placed below and within a predetermined distance of the dispensing opening 142, the infrared radiation from the energy emitter 148 is at least partially reflected by the hand to the energy detector 150. Upon sensing the reflected radiation, the energy detector 150 generates signals which are sent to the discrimination unit 156. These signals are indicative of the frequency of the infrared radiation sensed by the energy detector 150, and the discrimination unit 156 determines whether such frequency is the same as the frequency of the infrared radiation emitted by the energy emitter 148. Furthermore, the discrimination unit 156 determines whether the signals generated by the oscillator 154 and the signals generated by the energy detector 150 arrive at the discrimination unit 156 at the same intervals. If the frequency of the infrared radiation detected by the energy detector 150 equals the frequency of the infrared radiation emitted by the energy emitter 148 and the signals from the oscillator 154 and the energy detector 150 are received at the same intervals, the discrimination unit 156 causes the valve 140 to assume its open condition. The space 128 above the soap 126 is then placed in communication with the atmosphere and the pressure in the space 128 increases to atmospheric pressure. The soap 126 can thereupon flow out of the reservoir 114 into the tubular member 144 and through the dispensing opening 142 onto the hand below the opening 142.

Upon withdrawal of the hand from below the dispensing opening 142, infrared radiation from the energy emitter 148 is no longer reflected to the energy detector 150. The energy detector 150 stops sending signals to the discrimination unit 156 which, in turn, causes the valve 140 to return to its closed condition. When the valve 140 closes, the space 128 above the soap 126 is again cut off from the atmosphere and a vacuum redevelops in the space 128. Since the vacuum must overcome the kinetic energy of the flowing soap 126, the vacuum overshoots the value required to simply prevent the outflow of the soap 126 from the reservoir 114 when the soap 126 is stationary. As a result, once the soap 126 stops flowing, the relatively small volume of soap 126 present in the straight section 144*a* of the tubular member 144 is drawn into the curved section 144*c* of the tubular member 144. Inasmuch as the curved section 144*c* defines a depression between the straight sections 144*a*,144*b* of the tubular member 144, the soap 126 drawn out of the straight section 144*a* and into the curved section 144*c* is unable to escape from the curved section 144*c* while the valve 140 remains closed. Consequently, dripping of the soap 126 from the dispensing opening 142 is prevented.

The energy emitter 148 and the energy detector 150 of the soap dispenser 110 make it possible for the soap 126 to be discharged without touching the dispenser 110. Hence, the dispenser 110 is more sanitary than conventional soap dispensers. The removable cover 116 of the soap container 112 also allows easy access to the interior of the reservoir 114 so that the reservoir 114 can be easily cleaned.

Inasmuch as the soap dispenser 110 employs gravity to discharge the soap 126 from the dispenser 110, the dispenser 110 is relatively efficient. The efficiency of the dispenser 110 is enhanced because the fluid directly controlled by the valve 140 is air rather than the relatively viscous soap 126.

Since the valve 140 need only allow the passage of air therethrough, the valve 140 can be designed with a small flow aperture. This enables the valve 140 to be actuated with a relatively small amount of energy as the energy required to actuate a valve increases with increasing flow aperture size. Consequently, the energy supplied by a single small battery can suffice to operate the dispenser 110 for an extended period, e.g., 90 days. Moreover, the same valve can be used to dispense liquids with a wide range of viscosities.

Various modifications are possible within the meaning and range of equivalence of the appended claims. For example, the liquid dispensed could equivalently be, without limitation, a soap, a lotion, a beverage, a cleaner, a disinfectant, an adhesive, or a fabric treatment. Similarly, the container could consist of a deformable structure. Therefore, while the invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

I claim:

1. A liquid dispenser comprising:

a container for a supply of liquid, said container being provided with at least one opening for discharging liquid from said container;

means for detecting objects at a spacing from said container;

means for controlling the passage of liquid through said one opening, said controlling means having a first condition in which liquid is free to pass through said one opening and a second condition in which the passage of liquid through said one opening is inhibited, and said controlling means being designed to assume said first condition in response to the detection of an object by said detecting means and to revert to said second condition in response to discontinued detection of the object; and a circuit board, at least part of said detecting means and at least part of said controlling means being mounted on said circuit board.

2. The dispenser of claim 1, wherein said detecting means comprises an energy emitter and an energy detector.

3. The dispenser of claim 1, wherein said controlling means comprises a tube which extends into and is provided with an aperture in said container, said controlling means further comprising valve means for connecting said aperture with and disconnecting said aperture from the atmosphere.

4. The dispenser of claim 1, where in said liquid is a liquid soap.

5. The dispenser of claim 1, further comprising means for inhibiting dripping of liquid from said container.

6. The dispenser of claim 5, wherein said inhibiting means comprises a generally S-shaped tubular member.

* * * * *